United States Patent [19]

Yake

[11] Patent Number: 4,657,036

[45] Date of Patent: Apr. 14, 1987

[54] COMBINATION WATER INLET, VENT STACK, BLOWER AND BLOWER HOUSING ASSEMBLY FOR AN AUTOMATIC DISHWASHER

[75] Inventor: William H. Yake, Connersville, Ind.

[73] Assignee: Design & Manufacturing Corporation, Connersville, Ind.

[21] Appl. No.: 560,756

[22] Filed: Dec. 12, 1983

[51] Int. Cl.[4] ..... B08B 3/02

[52] U.S. Cl. ..... 134/95; 134/99; 134/115 R; 137/216

[58] Field of Search ..... 134/57 D, 94, 96, 97, 134/98, 99, 115, 95, 200; 137/216, 588

[56] References Cited

U.S. PATENT DOCUMENTS

| | | | |
|---|---|---|---|
| 1,511,825 | 10/1924 | Burns | 134/94 |
| 1,605,021 | 11/1926 | Barker | 134/94 X |
| 2,686,035 | 8/1954 | Wuesthoff | 137/216 X |
| 3,233,782 | 2/1966 | Ullman, Jr. et al. | 134/58 D X |
| 3,362,139 | 1/1968 | Williamson | 134/200 X |
| 3,381,700 | 5/1968 | Frymark | 137/216 |
| 3,387,388 | 6/1968 | Williamson | 134/200 X |
| 3,439,688 | 4/1969 | Sholtes | 137/216 X |
| 3,485,266 | 12/1969 | Sieghartner | 137/588 |
| 3,646,948 | 3/1972 | Athey | 134/97 X |
| 3,717,168 | 2/1973 | Yake | 68/207 X |
| 3,876,469 | 4/1975 | Schimke | 134/97 X |
| 4,259,945 | 4/1981 | Lawson | 134/115 R X |
| 4,307,742 | 12/1981 | Schrott | 134/115 R |
| 4,438,861 | 3/1984 | McGuffey | 137/216 X |

FOREIGN PATENT DOCUMENTS 2502983 7/1976 Fed. Rep. of Germany ... 134/115 R

*Primary Examiner*—Philip R. Coe
*Assistant Examiner*—Frankie L. Stinson
*Attorney, Agent, or Firm*—Frost & Jacobs

[57] ABSTRACT

A water inlet, vent stack, blower and blower housing combined assembly for use in an automatic dishwasher. The combined assembly comprises a water inlet nozzle having an inlet end connectable to a valve-controlled water source, and a discharge end. A vent stack is provided in the form of an open top chamber having sides, ends and a bottom, with a lateral conduit extending from the lower portion of one side to be sealingly engaged about an opening in the dishwasher vat. A blower housing is located beneath the vent stack, and a dust is located along side the vent stack. The lower end of the duct is connected to the blower housing and the upper end thereof is connected to and encloses the open upper end of the vent stack. The water inlet nozzle extends through an opening in the upper end of the duct with its discharge end extending into the vent stack. A motor and fan are mounted on a motor plate, in turn mounted on a blower plate. The blower plate is affixed to the blower housing. The combined assembly introduces wash and rinse water into the dishwasher vat, serves as a vent for the vat, and circulates air therein, requiring a single opening in the vat wall for these purposes. The water inlet nozzle and vent stack subassembly can be used alone to introduce wash and rinse water into the dishwasher vat and to serve as a vent for the vat.

22 Claims, 29 Drawing Figures

COMBINATION WATER INLET, VENT STACK, BLOWER AND BLOWER HOUSING ASSEMBLY FOR AN AUTOMATIC DISHWASHER

TECHNICAL FIELD

The invention relates to a water inlet, a vent stack, a blower and a blower housing for an automatic dishwasher, and more particularly to these elements combined in a single assembly, requiring a single aperture in the side of the dishwasher vat.

BACKGROUND ART

Prior art workers have devised numerous types of automatic dishwashers, including undercounter dishwashers, top loading dishwashers, front loading dishwashers and the like. The teachings of the present invention are applicable to all such dishwashers. While not intended as a limitation, for purposes of an exemplary showing, the teachings of the present invention will be described in their application to a typical portable, front loading dishwasher for home use.

The typical automatic dishwasher for home use is equipped to carry on a series of operations in sequence. A series of operations is most commonly referred to as a "cycle". Modern automatic dishwashers are generally so arranged as to permit the operator to select the operations making up a desired cycle, from the full gamut of operations of which the machine is capable. A typical but non-limiting cycle may include the following operations: fill, first rinse, drain, fill, second rinse, drain, fill, wash, drain, fill, third rinse, drain, fill, fourth rinse, drain and dry. The desired series of operations or cycle is timer controlled, the timer turning on and off the various machine functions necessary for a given operation, determining the length of time each machine function is on or off, and thus determining the length of time for each operation of the cycle.

The typical front opening dishwashing for home use comprises a vat, having a large opening in the front end thereof. The vat is located in a cabinet or casing, provided with a hinged, downwardly opening front door which closes the large front opening of the vat during operation of the dishwasher. The vat is generally provided with upper and lower rail mounted racks for table and silverware, together with one or more spray arms. Pump means are provided to recirculate water within the vat and to drain the vat. The vat may also be equipped with a heating coil. Other appurtenances may be provided, including a detergent dispenser, door latch, safety switch and the like, all of which are well known in the art.

An automatic dishwasher of this type has an opening in one of the vat walls, generally located above the normal water level of the vat, to which a water inlet means is attached. U.S. Pat. No. 3,717,168, for example, teaches a typical water inlet unit. The water inlet unit is normally connected by a hose to a solenoid-controlled water valve, in turn connected to a water source.

Some economy models of automatic home dishwashers have very limited venting or air circulating means, although such ventilating means are desirable during the drying step to create cross ventilation within the vat. In some early models, during or immediately after the drying cycle, the dishwasher door opened a slight amount to ventilate the vat. It is also common practice to provide vent means in association with the dishwasher door. In such an instance, the door is made up of an exterior panel and an inner liner attached to each other in spaced relationship so that the door is in essence hollow. Vent openings are provided in the exterior panel near the upper end of the door and additional vent openings are provided in the door liner, near the bottom thereof. In such an instance, some air circulation will occur as a result of the chimney effect of the door.

Some models of automatic dishwashers for home use have been provided with blower means connected to an opening in one of the vat walls and generally used in association with door vent means. In some instances, the blower is used to withdraw hot moist air from the dishwasher vat, resulting in cooler dry air entering the vat through the door vent means. In other instances, the blower may be used to introduce cooler dry air into the vat, the hot moist air exiting through the door vent means.

The present invention is based upon the discovery that a water inlet nozzle, a vent stack, a blower and a blower housing can be combined into a single assembly connected to a single opening in one of the vat walls above the normal water level of the vat and preferably below the lower rack. Thus, two normally incompatible functions are combined in a single unit of simple and inexpensive construction, eliminating at least one opening in the vat, each vat opening constituting a potential leak source.

Furthermore, the vent stack and water inlet nozzle subcombination, without the blower and blower housing, can be used alone to introduce wash and rinse water into the dishwasher vat and to serve as a vent for the vat.

DISCLOSURE OF THE INVENTION

According to the invention there is provided a combined assembly comprising a water inlet, a vent stack, a blower and blower housing for use in an automatic dishwasher. In general, the combined assembly comprises a water inlet nozzle having a body with a closed upper end and an open lower end. A hose connection extends laterally from the body near its upper end by which the water inlet nozzle may be joined to a valve-controlled water source. The water inlet nozzle may be provided with a one inch air gap (to be described hereinafter), as required by most Plumbing Codes.

The vent stack part of the assembly comprises an open top chamber having front and rear walls, end walls and a bottom. A gasketed lateral conduit extends from the lower portion of the front wall and sealingly engages about an opening in the dishwasher vat, when the assembly is mounted on the vat.

A blower housing is located beneath the vent stack. Duct means in association with the blower housing are located along side the vent stack. The lower end of the duct means is connected to the blower housing and the upper end of the duct means is connected to and closes the open upper end of the vent stack.

The body of the water inlet nozzle extends through an opening in the upper end of the duct means with the open bottom end of the water inlet nozzle extending into the vent stack.

A motor and squirrel cage fan are mounted on a motor plate which, in turn, is mounted on a blower plate. The blower housing and vent stack assembly is affixed to the blower plate. The overall assembly is affixed to the exterior of the vat by a series of screws extending from the interior of the vat, through the vat wall and into the assembly. The blower plate serves as a tapping plate for at least some of the screws.

In one embodiment of the assembly of the present invention, the blower is arranged to withdraw air from the vat, the air passing through the opening in the vat, the vent stack conduit, the vent stack, the duct means and the blower housing, exiting the blower housing. In this embodiment, the duct means comprises a blower back member affixed to and cooperating with the rear wall of the blower housing and the rear wall of the vent stack to form a duct. The upper end of the blower back member, which communicates with and closes the open upper end of the vent stack, is itself provided with slots whereby ambient air is mixed with the air withdrawn from the vat to decrease the moisture content per unit volume of the air exhausted by the blower from the blower housing. In this embodiment, air withdrawn from the vat by the assembly of the present invention is replaced with cooler dryer air from the door vents.

In a second embodiment of the present invention the blower is arranged to force ambient air into the vat. Air is drawn into the blower housing, and from the blower housing passes through the duct means into the vent stack. From the vent stack. the air enters the vat via the vent stack conduit and the opening in the vat. In this embodiment, the duct means constitutes an integral part of the blower housing. Ambient air entering the vat from the assembly of the present invention causes hot, moist air from the vat to exit through the door vent system.

In both embodiments the water inlet nozzle, the vent stack, the blower housing and the duct means are all capable of being molded of an appropriate plastic material suitable for use in the environment of a dishwasher and the temperatures involved.

The vent stack and water inlet subcombination of either of the above noted embodiments can be used alone to provide a combined water inlet-vent structure for those dishwashers not provided with a vent blower.

DETAILED DESCRIPTION OF THE INVENTION

Figure 1:
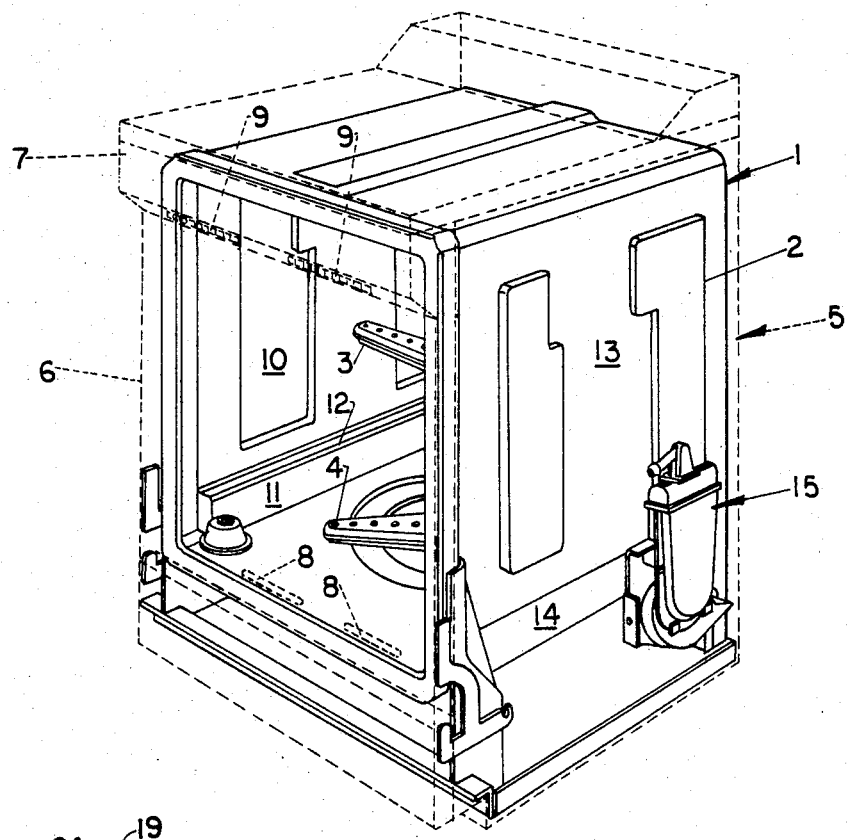
FIG. 1 is a perspective view of an exemplary dishwasher vat with the assembly of the present invention mounted thereon and with a surrounding cabinet and door indicated in broken lines.

Referring first to FIG. 1, there is shown in this Figure an exemplary automatic dishwasher for home use. The dishwasher is generally indicated at 1 and is illustrated as being of the portable type. The dishwasher comprises a vat 2 containing upper and lower tableware racks (not shown). The vat 2 will be provided with means to drain water therefrom and to recirculate water therein (again not shown). A pair of spray arms are shown at 3 and 4.

The exterior cabinet of the dishwashwer is illustrated in broken lines and generally indicated at 5. The cabinet 5 includes a front opening door 6. The upper end of the door terminates in a console 7 containing the timer and various dishwasher controls (not shown).

The door 6 is illustrated as being of the type having vent ports 8 formed in its inner liner near the bottom of the door and vent ports 9 formed in the outer door panel just below console 7. It will be understood that the inner liner and outer door panel define a hollow space therebetween connecting vent port 8 and vent ports 9.

The dishwasher 1 may be provided with other conventional appurtenances (not shown) such as a heating coil, a detergent dispenser, and the like.

The left wall 10 of vat 2 has an inset portion 11, defining a horizontal shoulder 12 constituting a track for the lower tableware rack. The right wall 13 of vat 2 has an inset portion 14, substantially identical to the inset portion 11, and also forming a track (not shown) for the lower tableware rack.

The combination water inlet, vent stack, blower and blower housing assembly of the present invention is generally indicated at 15 and is shown mounted to the inset portion 14 of right vat wall 13. The assembly communicates with an opening (not shown) in wall portion 14 near the lower and rearward edges of wall 13.

Figure 3:
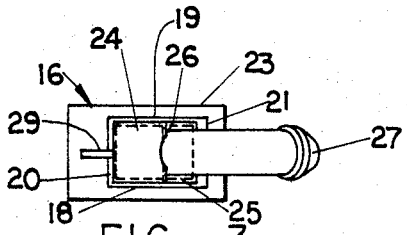
FIG. 3 is a plan view of the water inlet nozzle of FIG. 2.
Figure 2:
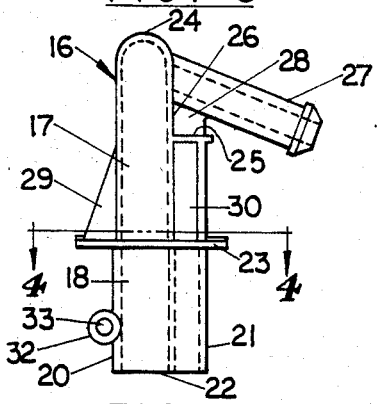
FIG. 2 is a front elevational view of the water inlet nozzle of a first embodiment of the present invention.
Figure 4:
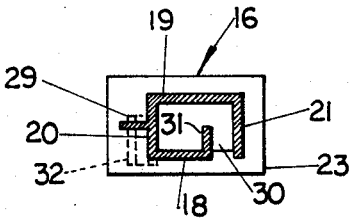
FIG. 4 is a cross sectional view taken along section line 4—4 of FIG. 2.

For an understanding of the assembly 15 and its construction, reference is first made to FIGS. 2 through 4 wherein the inlet nozzle of the assembly is illustrated and generally indicated at 16. Like parts have been given like index numerals throughout the drawings.

The water inlet nozzle 16 comprises an elongated body 17. The body 17 is made up of a front wall 18, a rear wall 19, and end walls 20 and 21. The bottom end 22 of the water inlet nozzle is open. Intermediate the upper and lower ends of body 17 there is a rectangular, laterally extending flange 23.

The upper end of body 17 is closed and is defined by an arcuate top portion 24, a horizontal top portion 25 and a connecting edge portion 26. A hose connection 27 extends laterally of edge portion 26, sloping outwardly and slightly downwardly. The hose connection is additionally braced by a gusset 28 extending between the hose connection 27, the wall 26, and top portion 25. An additional gusset 29 strengths laterally extending flange 23.

Front wall 18 is provided with an opening 30 approximately one inch in height and extending from end wall 21 to end wall 26. Below top portion 25, an internal wall 31, coplanar with end wall 26, extends from end wall 26 to the bottom 22 of body 17. As will be noted most clearly from FIG. 4, the internal wall 31 extends from front wall 18 approximately half way toward rear wall 19. The purpose of internal wall 31 is to serve as a baffle means to prevent water that enters the water inlet nozzle 16, via hose connection 27, from exiting through opening 30 in the front wall.

The opening 30 constitutes a one inch air gap, generally required by Plumbing Codes in association with water inlet means, so that if a negative pressure is produced in the water line, only air will be drawn into the water line. This precludes any possibility of drawing into the water line wash or rinse water from the vat 2.

The water inlet nozzle 16 is completed by a boss 32 extending laterally from end wall 20. The boss 32 has an axial perforation 33, adapted to receive a screw by which the water inlet nozzle 16 is attached to the vent stack, next to be described.

Figure 6:
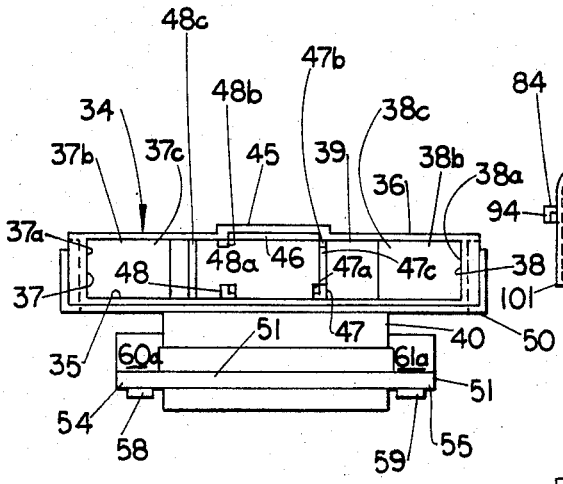
FIG. 6 is a plan view of the vent stack of FIG. 5.
Figure 12:
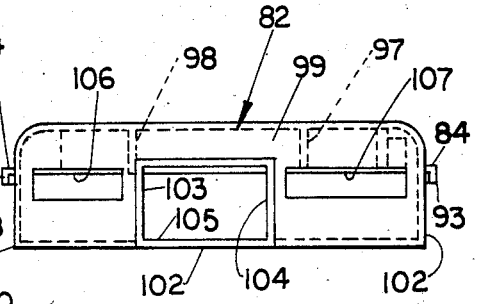
FIG. 12 is a plan view of the blower back member of FIG. 11.
Figure 5:
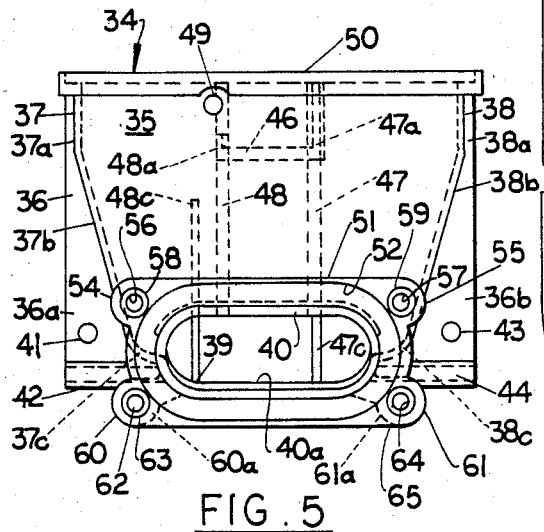
FIG. 5 is a front elevational view of the vent stack of the first embodiment of the present invention.

Reference is now made to FIGS. 5 and 6 wherein the vent stack is generally indicated at 34. The vent stack 34 is essentially an open top chamber having a front wall 35, a rear wall 36, end walls 37 and 38 and a bottom 39. Adjacent bottom 39, front wall 35 has a forwardly extending conduit 40 of oval configuration, the bottom portion **40*a* of which slopes slightly downwardly and outwardly from bottom 39**.

As can most clearly be seen in FIG. 5, the bottom 39 of vent stack 34 curves upwardly at its ends, substantially conforming to the general shape of the lower portion of conduit 40. The upper portion **37*a* of end wall 37 is vertical. This portion terminates in a downwardly and inwardly sloping portion 37*b* which, in turn, terminates in a portion 37*c* curving inwardly to meet the adjacent upwardly curved end of bottom 39. End wall 38 is similarly configured, having an upper vertical portion 38*a*, a downwardly and inwardly sloping portion 38*b* and a portion 38*c* curving inwardly to meet the adjacent curved end of bottom 39. The juncture of bottom 39 and rear wall 36 is a gentle curve, as shown at 39*a* in FIG. 15**.

Figure 15:
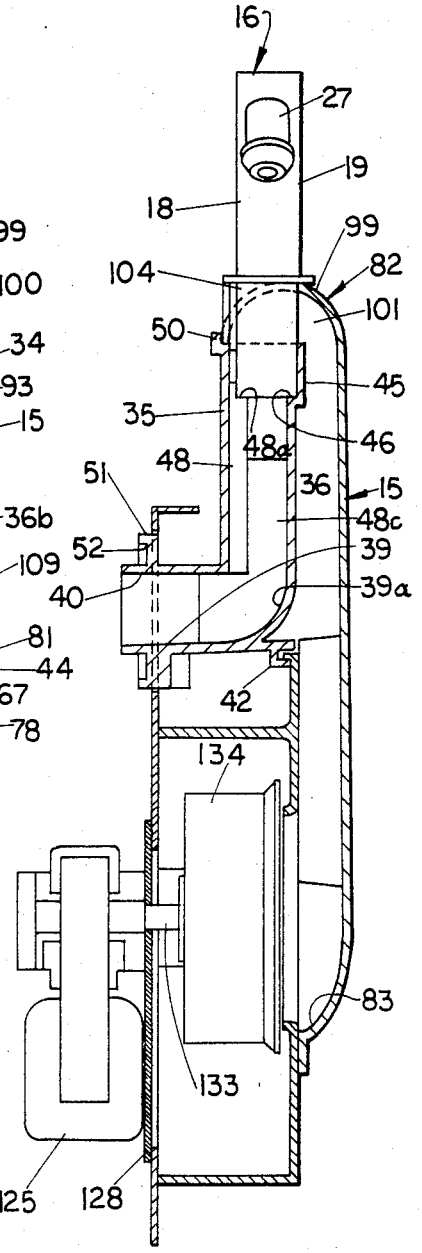
FIG. 15 is an end elevational view, partly in cross section, of the complete assembly of the first embodiment of the present invention.
Figure 16:
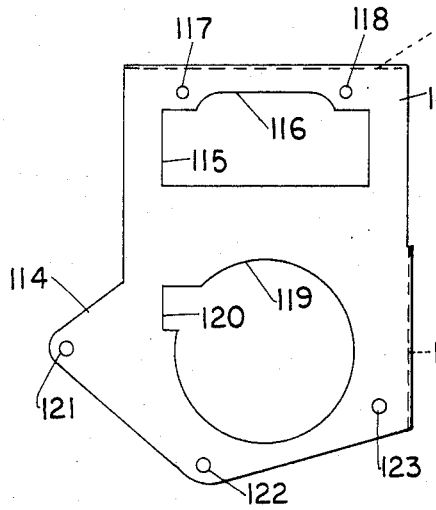
FIG. 16 is a front elevational view of the blower plate of the embodiment of FIG. 15.
Figure 17:
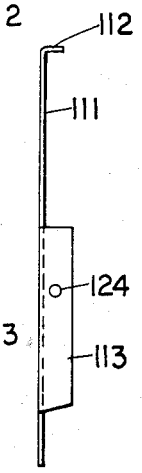
FIG. 17 is an end elevational view of the blower plate of FIG. 16.

The rear wall 36 of the vent stack 34 is substantially rectangular. As a result, it has portions **36*a* and 36*b* which extend beyond end walls 37 and 38. Rear wall portion 36*a* has a perforation 41 formed therein, the purpose of which will be described hereinafter. The lower edge of rear wall portion 36*a* is formed into a rearwardly opening channel-shaped portion 42. Rear wall portion 36*b* is provided with a perforation 43, similar to perforation 41 and it also terminates in a rearwardly opening channel-shaped bottom edge portion 44. The channel-shaped portion 42 is shown in FIG. 15 and the channel-shaped portion 44 is substantially identical thereto. The rear wall also has an outwardly extending, rectangular depressed portion 45, forming a shoulder 46. As will be evident hereinafter, the depressed portion 45 is dimensioned to just nicely receive the rear wall 19 of the water inlet nozzle 16, the shoulder 46 constituting an abutment stop for the bottom edge of the water inlet nozzle rear wall 19**.

The front wall 35 is provided with a pair of vertical ribs 47 and 48. As is clear from FIG. 5, the rib 47 extends from conduit 40 to the upper edge of front wall 35. The rib 48 extends vertically from conduit 40 to a position short of the upper edge of front wall 35, to make room for a perforation 49 in the front wall, the purpose of which will be described hereinafter. Ribs 47 and 48 are notched at their upper ends to form shoulders **47*a* and 48*a*. The shoulders 47*a* and 48*a* are coplanar with the shoulder 46 of rear wall 36. The ribs 47 and 48 are so spaced from each other as to receive just nicely the front wall 18 of water inlet nozzle 16, the shoulders 47*a* and 48*a* serving as abutment stops for the water inlet nozzle front wall 18**.

The rear wall 36 is provided on its inside surface with a pair of ribs **47*b* and 48*b* to either side of the depressed portion 45. The ribs 47*b* and 48*b* extend from the arcuate juncture 39*a* between bottom 39 and rear wall 36 to the upper edge of rear wall 36. The upper portions of ribs 47*b* and 48*b* lie to either side of the lower part of the water inlet nozzle 16 near the rear wall 19** thereof.

The front wall rib 47 and the rear wall rib **47*b* are joined by a web 47*c* which also extends part way into conduit 40 (see FIGS. 5 and 6). The web 47*c* serves as a baffle to prevent undue splash of water in the vent stack 34 during a filling operation. A similar web 48*c* is located to the left of front wall rib 48 and rear wall rib 48*b* and spans between front wall 35 and rear wall 36. Web 48*c* is similar to web 47*c*, extending part way into conduit 40**, and serves the same purpose as a baffle against water splash.

The vent stack 34 is completed by an upstanding lip 50. The lip 50 extends about the upper edges of front wall 35 and end walls 37 and 38.

Conduit 40 is surrounded by a laterally extending flange 51, inset from the forwardmost edge of conduit 40, as is shown in FIG. 6. The flange 51 has a depression or groove 52 formed in its forward face, surrounding conduit 40 (see also FIG. 15). The flange 51, its depression or groove 52 and the forwardmost end of conduit 40 are intended to support a resilient gasket 53, shown mounted in place in FIGS. 14 and 18.

The flange 51 has a pair of upper ears 54 and 55. The ears are respectively provided with perforations 56 and 57, surrounded by annular bosses 58 and 59. The purpose of perforations 56 and 57 will be evident hereinafter.

The flange 51, surrounding conduit 40, is also provided with a pair of lower ears 60 and 61. As is most clearly shown in FIG. 6, the lower ears 60 and 61 have portions 60*a* and 61*a* extending rearwardly of flange 51 so as to have a thickness considerably greater than the remainder of flange 51. The ear 60 has a bore 62 formed therein, surrounded by a boss 63. Similarly, ear 61 has a bore 64 formed therein, again surrounded by a boss 65. The purpose of bores 62 and 64 will be evident hereinafter.

Reference is now made to FIGS. 7 through 10 wherein the blower housing is generally indicated at 66. The blower housing 66 does not have a front wall, but is provided with a planar rear wall 67. Extending forwardly of rear wall 67 there is an arcuate end wall 68. Wall 68 terminates in a first end 68*a* and a second end 68*b*. Wall ends 68*a* and 68*b*, together with rear wall 67 define a portion of the blower housing outlet. Rear wall 67 has a large circular opening 69 located within wall 68 and constituting the blower housing inlet.

Wall 68 is provided with a series of exterior, laterally extending bosses 70, 71 and 72. The bosses have axial perforations 73, 74 and 75, respectively. The purpose of these perforations will be evident hereinafter.

Figure 9:
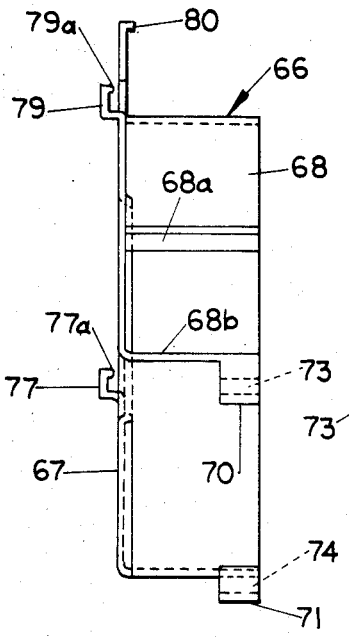
FIG. 9 is an end elevational view of the blower housing of FIG. 7.
Figure 7:
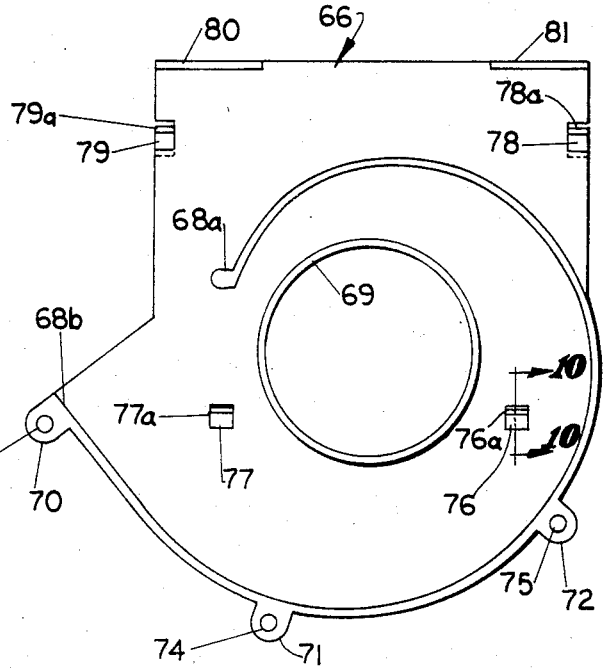
FIG. 7 is a front elevational view of the blower housing of the first embodiment of the present invention.

Rear wall 67 has a first pair of integral tabs 76 and 77 formed therein, near inlet opening 69. As is most clearly shown in FIG. 10, the tab 76 has a hook-shaped configuration 76*a* at its free end. The tab 77 has a similar hook-shaped configuration 77*a* at its free end, as is shown in FIG. 9. The rear wall 67 has a second pair of integral tabs 78 and 79 formed at its edges, above wall 68. The tabs 78 and 79 are similar to tabs 76 and 77 and terminate at their free ends in hook-shaped configurations 78*a* and 79*a*.

To complete the blower housing, the rear wall 67 has a pair of forwardly extending flanges 80 and 81. The flanges 80 and 81 are intended to be received in the channel-shaped portions 42 and 44 of the vent stack 34, as will be described hereinafter.

Figure 11:
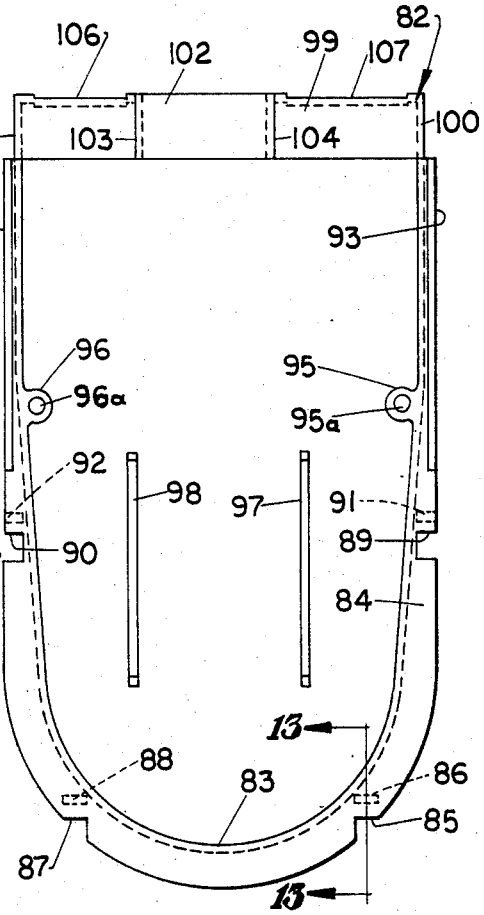
FIG. 11 is a front elevational view of the blower back member of the first embodiment of the present invention.
Figure 10:
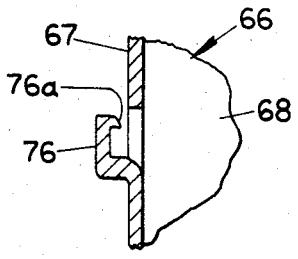
FIG. 10 is a fragmentary cross sectional view taken along section line 10—10 of FIG. 7.
Figure 8:
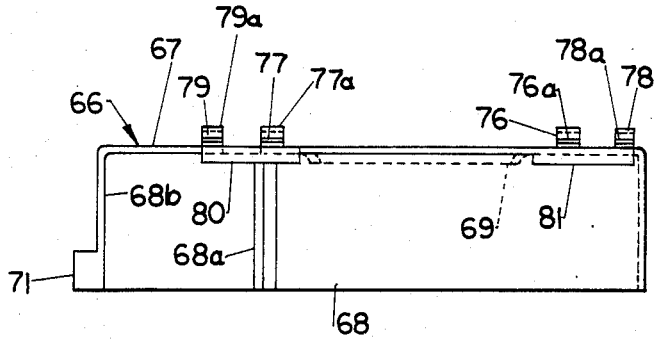
FIG. 8 is a plan view of the blower housing of FIG. 7.

Reference is now made to FIGS. 11, 12, 13 and 15, wherein the blower back member is generally indicated at 82. FIG. 11 is a front view of the blower back member 82, illustrating its interior surfaces. As is most clear from FIGS. 11 and 15, the blower back member is a dish-shaped member having an arcuate bottom 83. The sides and bottom of the blower back member 82 are surrounded by a flange 84.

Figure 13:
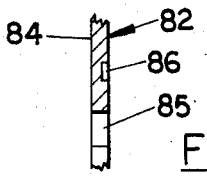
FIG. 13 is a fragmentary cross sectional view taken along second line 13—13 of FIG. 11.

Near the bottom of the blower back member, flange 84 has a notch 85 formed therein (see FIGS. 11 and 13). Immediately above the notch 85, the flange 84 has a depression 86 formed therein, opening to the rear of the blower back member. A similar notch 87 is formed in flange 84 with a similar depression 88. Along the sides of the blower back member, additional notches 89 and 90 are formed, each notch 89 and 90 having a depression formed thereabove in the rear face of flange 84, as at 91 and 92, respectively. Above the depressions 91 and 92, and on both sides of the blower back member, the flange 84 is provided with additional forwardly extending flanges 93 and 94. Adjacent the lower portions of flanges 93 and 94, the inner surface of the blower back member 82 is provided with a pair of bosses 95 and 96, having perforations 95*a* and 96*a* formed therein, respectively. The purpose of these bosses will be evident hereinafter. The interior surface of the blower back member is also provided with a pair of integral, spaced, parallel ribs 97 and 98, serving as reinforcing and spacing members and helping to channel air flow.

At its upper end, the blower back member 82 has an arcuate top portion 99 which extends forwardly and is provided with sides 100 and 101. The forward portion of the blower back member top 99 is so sized as to be received within the upstanding lip 50 of the vent stack 34 and to enclose the top of the vent stack 34. This is clearly shown, for example, in FIG. 15. Substantially centrally of the top portion 99, there is a vertical front wall 102 and side walls 103 and 104 defining a rectangular opening 105 in the top portion 99. The opening 105 is so sized as to accept the lower portion of the body 17 of the water inlet nozzle 16, together with the boss 32 thereon. When in place, the peripheral rectangular flange 23 of the water inlet nozzle 16 closes the rectangular opening 105. The blower back member 82 is completed by the provision of a pair of rectangular openings or vents 106 and 107 formed in the arcuate top portion 99.

The parts just described, including the water inlet nozzle 16, the vent stack 34, the blower housing 66 and the blower back member 82 constitute the casing portion of the assembly 15 of FIG. 1. Each of these parts lends itself well to being an integral one piece part molded of appropriate plastic material suitable for use in the environment of a dishwasher and capable of withstanding the temperatures involved. An exemplary plastic material is polypropylene, well known in the art.

Figure 14:
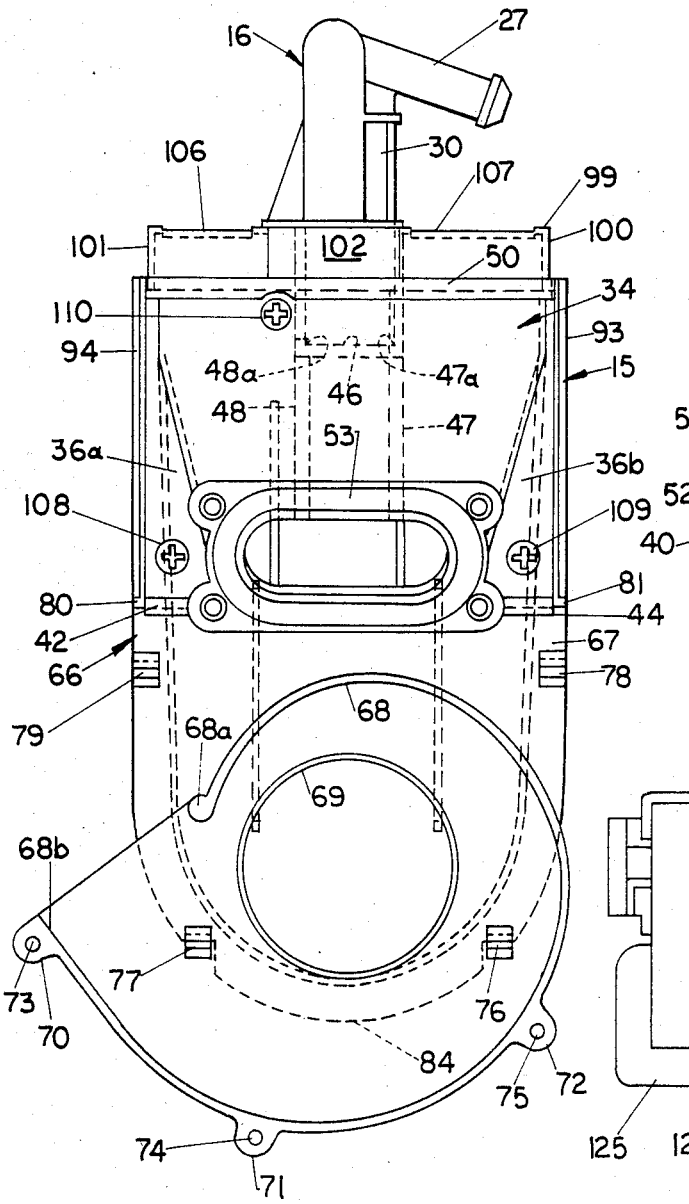
FIG. 14 is a front elevational view illustrating the assembly of the water inlet nozzle, vent stack, blower housing and blower back member of the first embodiment of the present invention.

FIGS. 14 and 15 illustrate these parts in assembled condition. Engagement of the blower back member 82 with the blower housing is a snap engagement, the blower housing tines 76 and 77 being received within blower back member notches 85 and 87, respectively, with the hooked portions 76*a* and 77*a* of the tines entering the rearward depressions 86 and 88, respectively. Similarly, the blower housing tines 78 and 79 are accommodated by the blower back member notches 89 and 90, respectively, with the hook-shaped free ends of the tines engaging the depressions 91 and 92 in the rear surface of the blower back member flange 84. To accomplish this engagement, the blower back member 82 is simply placed behind and against the blower housing 66 and the vent stack 34 at a position slightly above its normal position and with the tines 76, 77, 78 and 79 located in their respective notches 85, 87, 89 and 90. A slight downward movement of the blower back amember 82 will located the blower back member in its final position and will result in the snap engagement of the tine hooked end portions in their respective depressions in the blower back member flange 84.

The blower housing 66 is located beneath the vent stack 34 with the blower housing forwardly extending flanges 80 and 81 nested in the channel portions 42 and 44 of the vent stack 34. The blower back member 82 is located behind the vent stack 34 with its upper end 99 closing the upper end of the vent stack 34 and located within the lip 50 formed thereabout.

The vent stack 34 is firmly affixed to the blower back member 82 by means of screws 108 and 109. The screw 108 passes through perforation 41 in the vent stack rear wall portion 36*a* and engages in the bore 96*a* in the boss 96 of the blower back member 82. Similarly, the screw 109 passes through perforation 43 in the vent stack rear wall portion 36*b*, and engages in the bore 95*a* of boss 95 of the blower back member 82. The side edges of the rear wall 36 of the vent stack 34 are abutted by the flange 84 of the blower back member, and are located between the additional forwardly extending flanges 93 and 94 of the blower back member 82.

The casing portion of the assembly 15 is completed by insertion of the lower body portion of water inlet nozzle 16 through the opening 105 in the top portion 99 of the blower back member 82. The water inlet nozzle 16 is inserted until the lower edge of its front wall 18 abuts the shoulders 47*a* and 48*a* of ribs 47 and 48 in the vent stack 34 and the rear wall 19 of the water inlet nozzle 16 abuts the shoulder 46 formed in the rear wall 36 of the vent stack 34. At the same time, the peripheral flange 23 of the water inlet nozzle 16 closes the opening 105 in the top portion 99 of the blower back member 82. The water inlet nozzle 16 is locked in its seated position by means of screw 110. The screw 110 passes through the perforation 49 in the front wall 35 of the vent stack 34 and into the perforation 33 of the water inlet nozzle boss 32.

Reference is now made to FIGS. 15 through 19. With particular attention to FIGS. 16 and 17, the assembly of the present invention is provided with a blower plate 111. The blower plate comprises a planar member having a rearwardly extending flange 112 along its upper edge and a second rearwardly extending flange 113 along one of its sides. The opposite side of the blower plate has an extension 114 so that the lower portion of the blower plate 111 more nearly conforms to the general shape of the blower housing. In the upper portion of blower plate 111 there is a rectangular opening 115. The upper edge of the opening 115 is extended as at 116 and configured to generally conform to the upper surface of vent stack conduit 40. Above opening 115 there is a pair of perforations 117 and 118.

The lower portion of the blower plate has a circular opening 119 formed therein. The opening 119 includes an additional notch-like opening 120, the purpose of which will be described hereinafter. To complete the blower plate, additional perforations 121, 122 and 123 are formed in the face thereof, together with perforation 124 formed in the rearwardly extending side flange 113.

Figure 19:
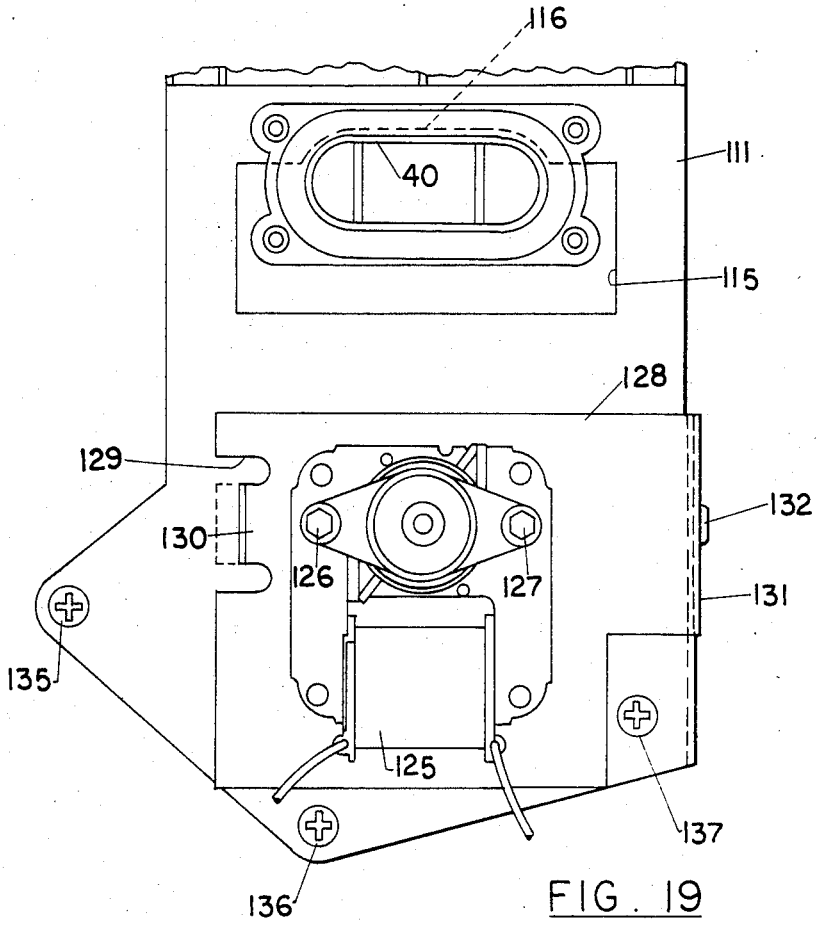
FIG. 19 is a fragmentary front elevational view illustrating the motor, the motor plate, the blower plate and a portion of the vent stack of the assembly of FIG. 18.

Referring more specifically to FIGS. 15 and 19, a motor 125 is mounted by means of bolts 126 and 127 to a motor plate 128. The motor plate 128 has a notch 129 formed therein. The notch 129 defines a hook-shaped tongue 130. As is evident from FIG. 19, the tongue 130 engages the notched portion 120 of blower plate opening 119. At its opposite side edge, the motor plate 128 has a rearwardly extending flange 131. This flange overlies the rearwardly extending flange 113 of blower plate 111 and is provided with a perforation (not shown) coaxial with the perforation 124 of the blower plate 111. A screw 132 extends through the perforation in motor plate flange 131 and the perforation 124 in blower plate 111. The combination of the tongue 130 engaged in the slotlike opening 120 and the screw 132 securely mounts the motor plate and its motor to the blower plate. The motor 125 has a shaft 133 on which a squirrel cage fan 134 is mounted.

Figure 18:
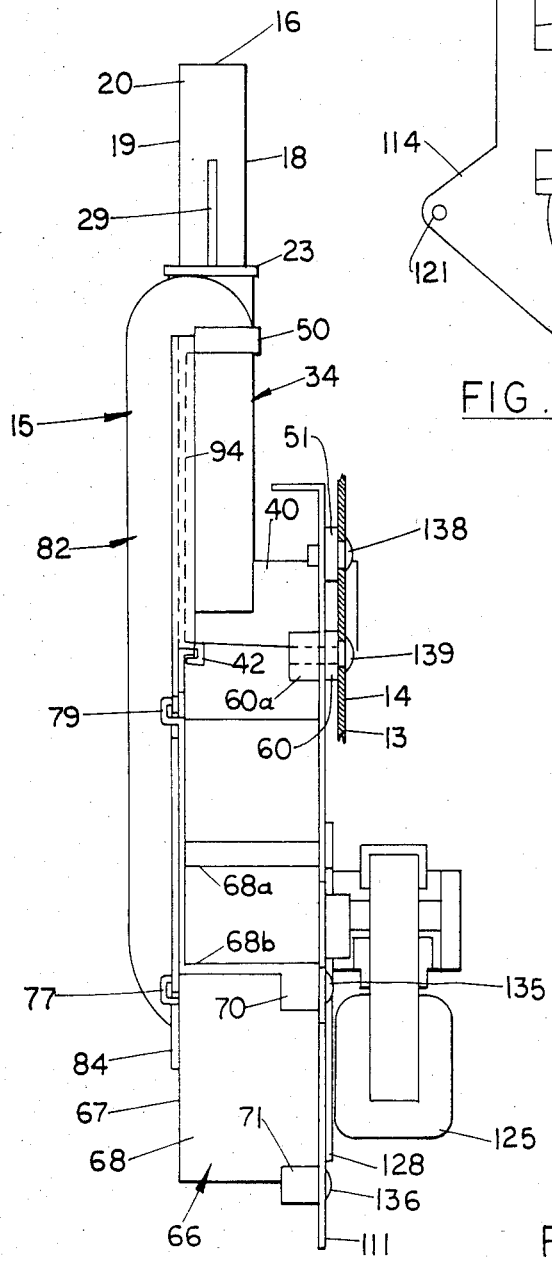
FIG. 18 is an end elevational view of the complete assembly of the first embodiment of the present invention.

Referring to FIGS. 15, 18 and 19, the blower plate 111 is located on the front of the casing assembly of FIG. 14 with the vent stack conduit 40 extending through the blower plate opening 115 and nested in the portion 116 of that opening. The blower plate 111 is attached in place by means of screws 135, 136 and 137 which enter the bores 73, 74 and 75 of the blower housing bosses 70, 71 and 72, respectively. It will be evident that the lower portion of blower plate 111 serves as a front wall for blower housing 66. With the blower plate 111 in place, the motor plate 128 (having the motor 125 mounted thereon and the fan 134 mounted on the motor shaft) is located on the blower plate 111, by inserting the fan 134 through the opening 119 of blower plate 111 the hook-shaped tongue 130 of the motor plate 128 is engaged in the notch 120 of the blower plate 111 and the blower plate flange 113 and the motor plate flange 131 are joined together by screw 132. This essentially completes the assembly 15 which is then ready for mounting on the portion 14 of vat wall 13.

The mounting of the assembly 15 on vat wall portion 14 is accomplished in the following manner. The vat wall portion 14 is provided with an opening (not shown), corresponding to the vent stack conduit 40. Additional perforations (not shown) are provided in wall portion 14 corresponding to the annular bosses 58, 59, 63 and 65 surrounding the bores 56, 57, 62 and 64 of the vent stack conduit flange ears 54, 55, 60 and 61.

When the assembly 15 is properly located with the vent stack conduit 40 in alignment with the opening in the vat wall portion 14, a pair of screws (one of which is shown at 138 in FIG. 18) are inserted from the interior of the vat wall portion 14 through perforations 56 and 57 in the vent stack conduit flange ears 54 and 55 and into perforations 117 and 118 of the blower plate (see FIG. 16), the screws being threadedly engaged in the blower plate. In this manner, the blower plate serves as a tapping plate. Additional screws (one of which is shown at 139 in FIG. 18) pass through perforations in the vat portion 14 and into the bores 62 and 64 of the vent stack conduit flange ears 60 and 61 and are threadedly engaged in these bores. The gasket 53 is compressed as the screws are tightened, moving the conduit 40 and bosses 58, 59, 63 and 65 into the corresponding opening and perforations in the vat wall 14, making a seal between vat wall portion 14 and conduit 40.

The assembly 15 having been described in detail, its operation may be set forth as follows. During wash and rinse operations when water is required to be introduced into vat 2, the dishwasher timer will cause the solenoid actuated water valve (not shown) of the dishwasher to open and water will be conducted by a hose or conduit into the water inlet nozzle 16 via hose coupling 27. The water will pass through the body portion 17 of the water inlet nozzle 16 and exit through its open bottom 22. The inner wall or baffle 31 of the water inlet nozzle 16 will prevent water from exiting through the air gap opening 30. Water from the water inlet nozzle 16 enters directly into the vent stack 34, passing through the vent stack conduit 40 and into the vat.

During the drying operation, the timer actuated control of the dishwasher will activate the motor 125 of assembly 15 causing the fan 134 to rotate. The fan will withdraw hot moist air from vat 2 through the vent stack conduit 40, the vent stack 34, and through the blower back member 82 into the blower housing inlet 69. This air will be discharged by the fan 134 through the blower housing exit. The rectangular openings 106 and 107 in the arcuate top portion 99 of the blower back member 82 serve as mixing slots. A negative pressure existing at these slots, ambient air will be drawn into the blower back member and mixed with air from the tub to decrease the moisture content per unit volume of the air exhausted through the blower housing 66 by fan 134.

The hot moist air withdrawn by assembly 15 from the vat will be replaced by cooler but drier, ambient air by means of the air vents 8 and 9 in door 6. The slots 106 and 107 in the blower back member 82 may also enhance drying after the blower motor 125 has been shut off by the dishwasher timer.

During those parts of the cycle when the blower motor 125 is shut off, and air within the vat is expanding due to heat within the vat, the blower back member slots 106 and 107 will serve as pressure release vents in conjunction with door vents 8 and 9.

Figure 28:
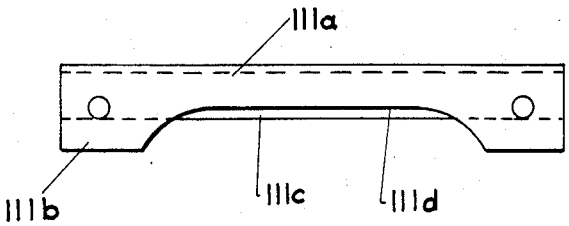
FIG. 28 is a front elevational view of a tapping plate.
Figure 29:
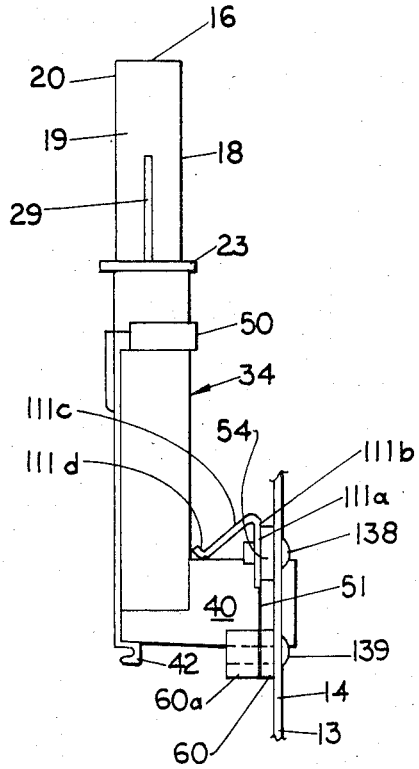
FIG. 29 is an end elevational view of the water inlet nozzle-vent stack assembly of the present invention.

In some dishwasher models, it is within the scope of the present invention to utilize water inlet nozzle 16 and the vent stack 34 only, eliminating blower housing 66, blower back member 82, motor 125, motor plate 128 and fan 134. The water inlet nozzle 16 may be mounted within the vent stack 34 and secured with a screw in precisely the same manner described above. The vent stack conduit 40 is affixed to the vat wall portion 14 in precisely the same manner described above, utilizing a small tapping plate 111*a*, similar to the upper portion of blower plate 111. Small tapping plate 111*a* is illustrated in FIGS. 28 and 29. Tapping plate 111*a* comprises a vertical front wall portion 111*b* terminating at its upper edge in a downwardly and rearwardly extending rear wall 111*c*, the rearward edge 111*d* of which is upturned. Front wall 111*b* has a notch 111*e* formed in its lower edge and shaped to conform to the upper surface of vent stack conduit 40. Front wall 111*b* also has a pair of perforations 111*f* and 111*g* equivalent to perforations 117 and 118 of blower plate 111. Small tapping plate 111*a* is mounted on vent stack conduit 40 as shown in FIG. 29 with its perforations 111*f* and 111*g* aligned with vent stack conduit perforations 56 and 57, respectively. Screws (one of which is shown at 138) pass through perforations in portion 14 of vat wall 13, vent stack conduit perforations 56 and 57 and threadedly engage perforations 111*f* and 111*g* in small tapping plate 111*a*. In its application as a water inlet, this arrangement would operate in precisely the same manner as the complete assembly 15. During the drying operation, hot moist air would exit the vat via the door vents 8 and 9, due to the chimney effect thereof. The vent stack 34, under these circumstances, will serve primarily as air inlet, permitting ambient air to replace the hot moist air exiting through door vents 8 and 9. The open upper end of vent stack 34 will serve the same pressure release function for warm expanding air, as described with the vent slots 106 and 107 of the blower back member 82.

A second embodiment of the assembly of the present invention is illustrated in FIGS. 20 through 27, wherein like parts have been given like index numerals. This embodiment differs from the previously described embodiment primarily in that the blower and casing assembly is arranged to introduce ambient air into the vat, rather than to withdraw hot moist air therefrom.

Figure 26:
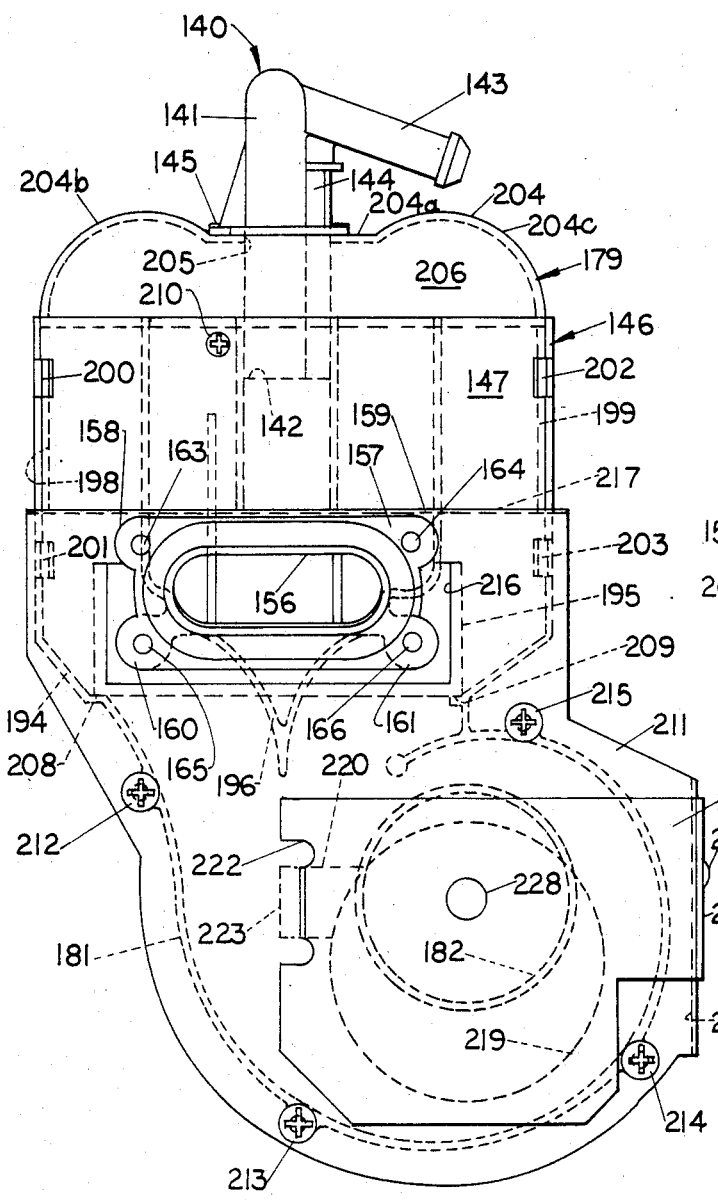
FIG. 26 is a front elevational view of the complete assembly of the second embodiment of the present invention, with the blower, blower plate, motor and motor plate removed.

Turning first to FIG. 26, this embodiment of the assembly of the present invention is provided with a water inlet nozzle, generally indicated at 140, which is substantially identical to the water inlet nozzle 16 of FIGS. 2 through 4. To this end, the water inlet nozzle 140 has an elongated body 141 with an open bottom 142, a hose coupling 143, a one inch air gap 144, and a laterally extending peripheral flange 145. The water inlet nozzle 140 will have an internal wall (not shown) equivalent to the wall 31 of water inlet nozzle 16 and serving as a baffle to prevent water from exiting the inlet nozzle through the air gap 144. Near its lower end, the water inlet nozzle 140 will be provided with a laterally extending boss (not shown) equivalent to the boss 32 of the water inlet nozzle 16.

Figure 22:
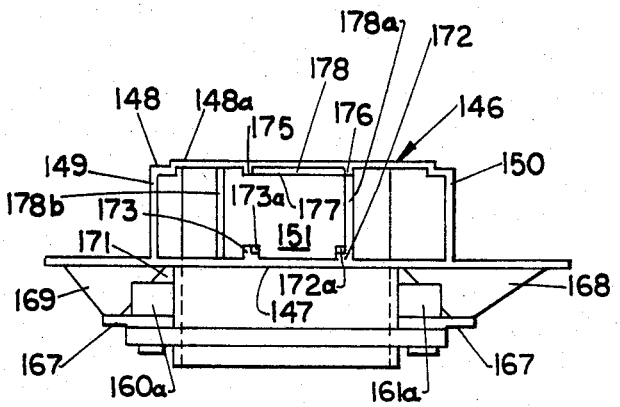
FIG. 22 is a plan view of the vent stack of FIG. 20.
Figure 20:
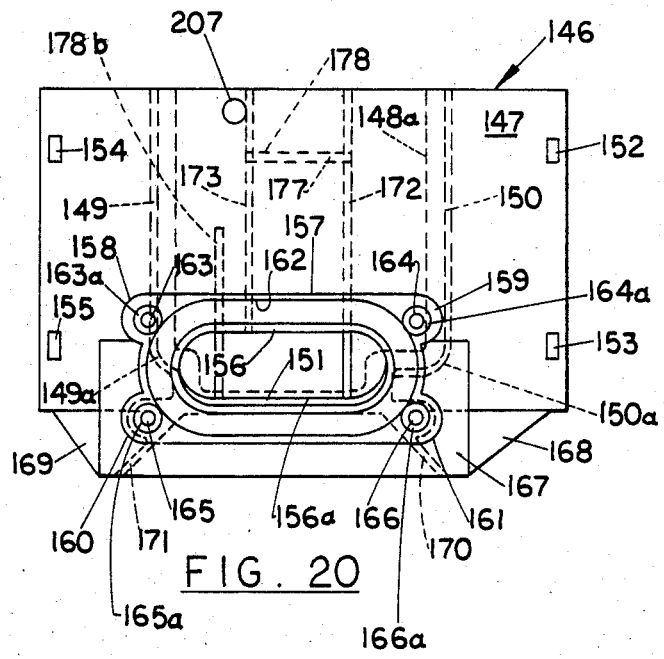
FIG. 20 is a front elevational view of a vent stack of the second embodiment of the present invention.
Figure 21:
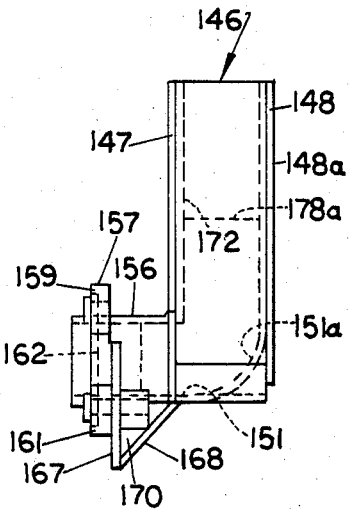
FIG. 21 is an end elevational view of the vent stack of FIG. 20.

The vent stack of this embodiment of the present invention is illustrated in FIGS. 20 through 22 and is generally indicated at 146. Again, the vent stack 146 comprises an open top chamber having a front wall 147, a rear wall 148, end walls 149 and 150, and a bottom 151. As can be most clearly seen in FIG. 20, the bottom 151 curves upwardly at its ends. End walls 149 and 150, near their bottom ends, curve inwardly as at 149*a* and 150*a* to meet the bottom 151. The bottom 151 also curves gently upwardly into rear wall 148, as shown at 151*a* in FIG. 21.

The front wall 147 is rectangular in configuration and is of greater width than rear wall 148, extending laterally beyond end walls 149 and 150. Near its lateral edges, front wall 147 is provided with openings 152, 153, 154 and 155. The purpose of these openings will be described hereinafter. A conduit 156, substantially identical to conduit 40 of vent stack 34, extends forwardly from the lower portion of front wall 147. The lower portion of conduit 156 slopes slightly downwardly and outwardly from vent stack bottom 151, as at 156*a*. The conduit 156 is provided with a surrounding flange 157, substantially identical to flange 51 of vent stack 34, and is similarly provided with upper ears 158 and 159, and lower ears 160 and 161. The lower ears 160 and 161 have rearwardly extending portions 160*a* and 161*a*, equivalent to the portions 60*a* and 61*a* of vent stack 34. The forward face of flange 157 is provided with a groove 162, surrounding conduit 156, and intended to accommodate a gasket, in the same manner as described above with respect to groove 52 of vent stack 34. Upper ears 158 and 159 are provided with perforations 163 and 164 surrounded by bosses 163*a* and 164*a*, respectively. Lower ears 160 and 161, and their respective rearward extension 160*a* and 161*a*, are provided with bores 165 and 166 surrounded by bosses 165*a* and 166*a*, respectively.

An integral, vertical, panel-like structure 167 is located immediately behind flange 157 and is in parallel spaced relationship to front wall 147. As will be obvious from FIG. 20, the panel-like member 167 extends beneath conduit 156 and partway up the sides of the conduit. The panel-like member 167 is connected to the lower edge of front wall 147 by downwardly and forwardly sloping panels 168 and 169. The space between panel 167, panel 168 and conduit 156 is closed by a downwardly and outwardly sloping panel 170. Similarly, the space between vertical panel 167 and panel 169 is closed by downwardly and outwardly sloping panel 171.

The inside surface of front wall 147 is provided with a pair of vertical ribs 172 and 173, in parallel spaced relationship. The rib 172 is notched so as to form a shoulder 172*a* and the rib 173 is similarly notched to form a shoulder 173*a*. The ribs 172 and 173 extend upwardly from conduit 156 to the upper edge of the front wall 147. The ribs 172 and 173, and their respective shoulders 172*a* and 173*a* are similar to and serve the same purpose as ribs 47 and 48 and their respective shoulders 47*a* and 48*a* of the vent stack 34.

The rear wall 148 of the vent stack 146 has a rearwardly depressed portion 148*a*. Within the rearwardly depressed portion, a pair of internal vertical, parallel, spaced ribs 175 and 176 are formed. The ribs 175 and 176 are joined together by a horizontal rib 177 forming a shoulder 178. The shoulder 178 of the rear wall portion 148*a* and the shoulders 173*a* and 172*a*, in association with front wall 147, serve as abutment supports for the front and rear edges of the open bottom 142 of water inlet nozzle 140, in the same way described with respect to shoulders 46, 47*a* and 48*a* of vent stack 34.

The front wall rib 172 and the rear wall rib 176 are joined by a web 178*a* which also extends part way into conduit 156 (see FIGS. 20 and 21). A similar web 178*b* joins front wall 147 and rear wall 148 to the left of ribs 173 and 175 (as viewed in FIGS. 20 and 22), and extends part way into conduit 156. These webs are similar to webs 47*c* and 48*c* of FIG. 5, and serve as baffles to prevent undue splash of water in vent stack 146.

Figure 25:
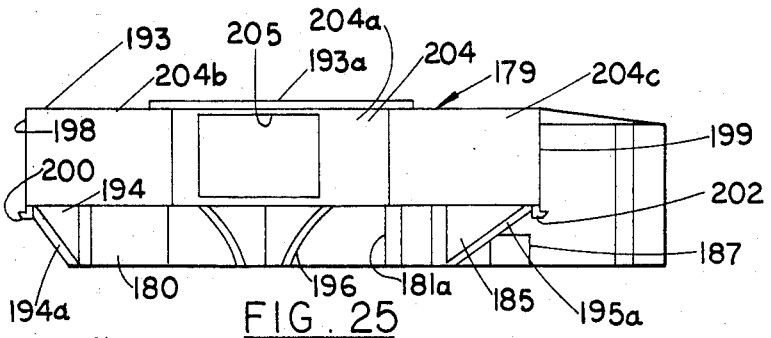
FIG. 25 is a plan view of the blower housing and duct member of FIG. 23.
Figure 23:
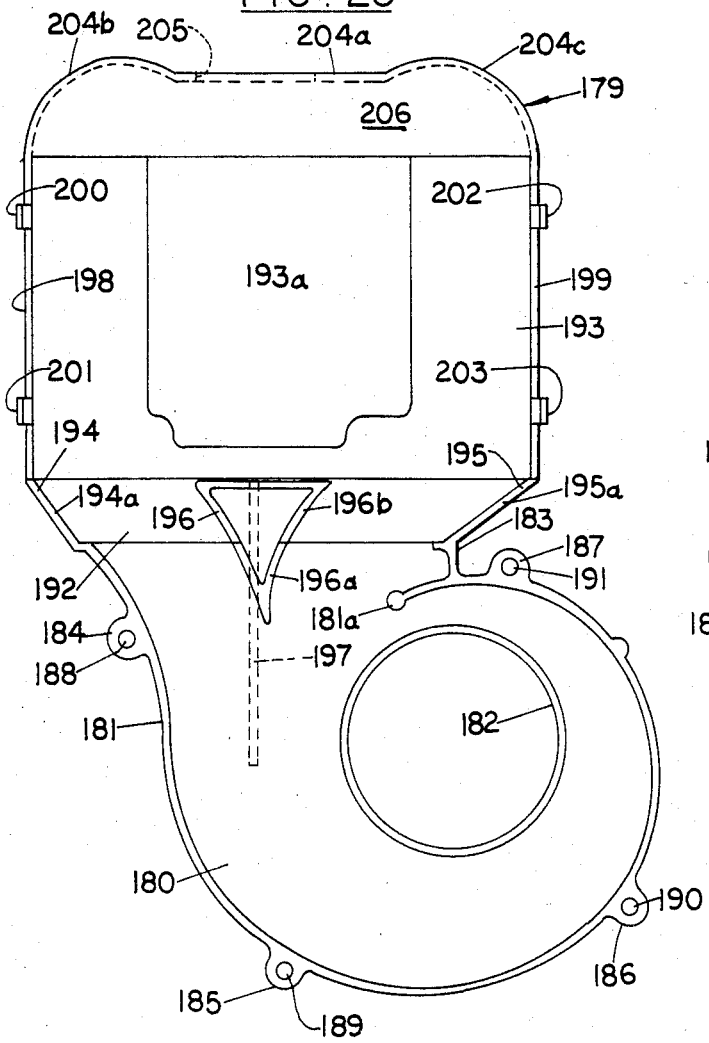
FIG. 23 is a front elevational view of the blower housing and duct member of the second embodiment of the present invention.
Figure 24:
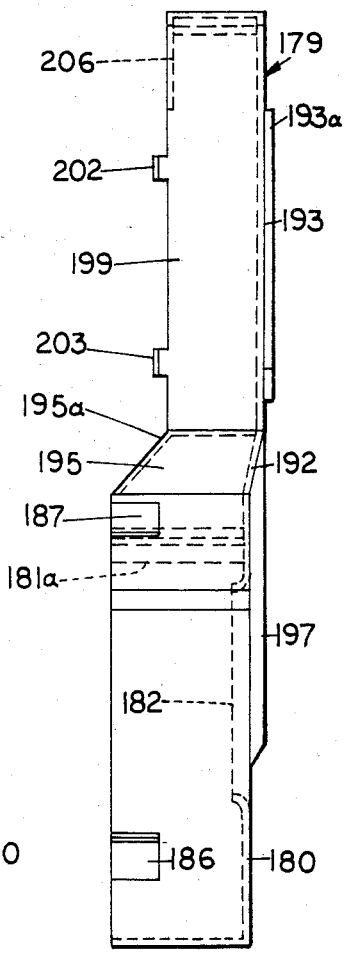
FIG. 24 is an end elevational view of the blower housing and duct member of FIG. 23.

.Reference is now made to FIGS. 23, 24 and 25, wherein a combination blower housing and duct member is generally indicated at 179. The blower housing portion of this member comprises a rear wall 180 surrounded by an arcuate end wall 181, terminating at 181*a*. The end portion 181*a* and that part of wall 181 directly across therefrom define the blower housing outlet. The wall 180 has a circular perforation 182 formed therein, constituting the blower housing inlet. The blower housing portion also includes a small end wall portion 183. Along the exterior of end wall 181, bosses 184, 185, 186 and 187 are located, having bores 188, 189, 190 and 191 formed therein. The bosses 184 through 187 and their respective bores 188 through 191 are used to attach a blower plate to the combination blower housing and duct member 179, as will be explained hereinafter.

The rear wall 180 terminates at its upper edge in an upwardly and rearwardly sloping rear wall portion 192. This wall portion, in turn, terminates in a vertical rear wall portion 193. Wall portion 192 is provided with end walls 194 and 195. As will be evident from FIGS. 24 and 25, the front edges 194*a* and 195*a* of end walls 194 and 195 also slope upwardly and rearwardly.

Rear wall portions 180 and 192 support an integral, substantially triangular, air flow divider 196. The front edge portion 196*a* of that part of divider 196 supported by rear wall 180 is coplanar with the front edge of end wall 181. The front edge portion 196*b* of that portion of divider 196 supported by rear wall 192 slopes upwardly and rearwardly at the same angle as end wall front edges 194*a* and 195*a*. An integral strengthening rib 197 is formed on the exterior surface of rear walls 180 and 192.

Vertical rear wall 193 has a rearwardly depressed portion 193*a* conforming in shape to the rearwardly depressed portion 148*a* of the vent stack rear wall 148. Rear wall 193 is provided with end walls 198 and 199. The forward edge of end wall 198 is provided with a pair of forwardly extending hook-shaped tines 200 and 201. In similar fashion, the end wall 199 is provided at its forward edge with hook-shaped tines 202 and 203. The purpose of tines 200 through 203 will be evident hereinafter.

The rear wall 193 is also provided with a top wall 204 having a horizontal central portion 204*a* and arcuate end portions 204*b* and 204*c*, which join the upper ends of end walls 198 and 199, respectively. The central horizontal portion 204*a* of top wall 204 has a rectangular opening 205 therein, for receipt of the lower portion of water inlet nozzle 140.

To complete the combination blower housing and duct member, a short front wall 206 is provided, the purpose of front wall 206 will be evident hereinafter.

The water inlet nozzle 140, the vent stack 146 and the blower housing and duct member 179 constitute the casing portion of the assembly of FIGS. 20 through 27. These elements lend themselves well to being molded of appropriate plastic material, such as that material described with respect to water inlet nozzle 16, vent stack 34, blower housing 66 and blower back member 82.

The assembly of the embodiment of FIGS. 20 through 27 will now be described, with particular reference to FIGS. 26 and 27. The first step of the assembly is to locate the vent stack 146 within the upper or duct portion of the blower housing and duct member 179. The depressed portion 148*a* of the rear wall 148 of vent stack 146 will be received within the depression 193*a* of the rear wall portion 193 of the blower housing and duct member 179. At the same time, the hook-shaped tines 200 and 201 on end wall 198 of the blower housing and duct member 179 will be received through openings 154 and 155, respectively, in the front wall 147 of vent stack 146 with a snap fit. Similarly, hook-shaped tines 202 and 203 on end wall 199 of the blower housing and duct member 179 will be received through openings 152 and 153, respectively, of the vent stack front wall 147 with a snap fit. In this way, the vent stack 146 is firmly attached to the blower housing and duct member 179, with the front panel member 167 of vent stack 146 resting on shoulders 208 and 209 (see FIGS. 23, 25 and 26) formed between end wall portions 181, 194 and 195 of the blower housing and duct member 179.

Figure 27:
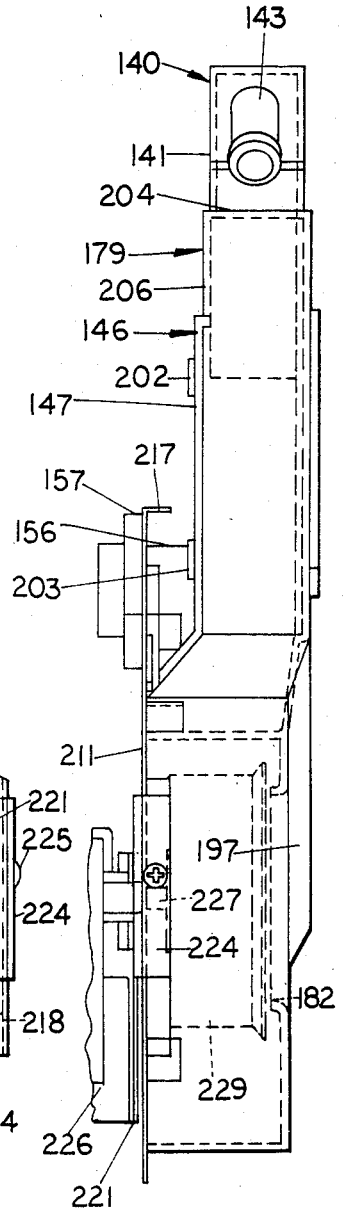
FIG. 27 is an end elevational view, partly in cross section, of the complete assembly of the second embodiment of the present invention.

As will be evident from FIGS. 26 and 27, the upper edge of vent stack front wall 147 laps the lower edge of the blower housing and duct member front wall 206 to fully enclose the upper portion of the blower housing and duct member. Small panel portions 168 and 169 meet with and enclose end wall portions 194 and 195 of the blower housing and duct member 179.

The lower portion of the water inlet nozzle 140 is inserted through perforation 205 in the top portion 204*a* of blower housing and duct member 179. The edges defining the open bottom 142 of the water inlet nozzle 140 rests upon vent stack shoulders 172*a*, 173*a* and 178. The water inlet nozzle 140 is provided with a lateral boss comparable to the boss 32 of water inlet nozzle 16. A screw 210 extends through the perforation 207 in the vent stack front wall 147 (see FIG. 20) and into the boss of the water inlet nozzle 140, maintaining the water inlet nozzle in position.

As is most clearly shown in FIGS. 26 and 27, a blower plate 211, similar to blower plate 111, is provided. Blower plate 211 is attached to the blower housing portion of the blower housing and duct member 179 by means of screws 212 through 215, which enter the bores 188 through 191 of bosses 184 through 187, respectively, of the blower housing and duct member 179. The blower plate 211 has a first opening 216 formed therein, similar to the opening 115 of blower plate 111. The forward end of conduit 156 and its flange 157 extend through the opening 116. It will be understood that blower plate 211 will have a pair of perforations coaxial with conduit flange perforations 163 and 164, and similar to perforations 117 and 118 of FIG. 16. The blower plate 211 has an upper rearwardly extending flange 217 along its upper edge and a second rearwardly extending flange 218 along its right side, as viewed in FIG. 26. The flanges 217 and 218 are respectively equivalent flanges 112 and 113 of FIG. 17. The blower plate is completed by a second circular opening 219 formed therein, equivalent to the opening 119 of FIG. 16. The opening 219 has a laterally extending notch 220, equivalent to the notch 120 of FIG. 16.

A motor plate 221 is provided. The motor plate is essentially the same as the motor plate 128 of FIG. 19. The motor plate 221 has a notch 222 which defines a hookshaped tab 223. The tab 223 is equivalent to the tab 130 of FIG. 19 and is engagable in the blower plate notch 220.

The motor plate 221 has a flange 224 adapted to overlie the blower plate flange 218. A screw 225 passes through both flanges and, in this way, the motor plate is firmly attached to the blower plate. As is shown in FIG. 27, the motor plate 221 supports a motor 226. The shaft 227 of motor 226 passes through a perforation 228 in the motor plate and supports a fan 229 within the blower housing and duct member 179.

The embodiment of FIGS. 20 through 27 is affixed to and sealed against the wall portion 14 of vat wall 13 in precisely the same manner described with respect to the first embodiment. The operation of the embodiment of FIGS. 20 through 27 is as follows. During the wash and rinse operations, the dishwasher solenoid controlled water valve will be opened by the timer mechanism at the appropriate times and for the appropriate intervals. Water will enter the hose coupling 143 of the water inlet nozzle 140 and be discharged through the open bottom end thereof into the vent stack. From the vent stack, water will enter directly into the vat through the vent stack conduit 156. Thus, in its function as a water inlet, the embodiment of FIGS. 20 through 27 operates in a manner identical to the previously described embodiment.

During a drying operation, the dishwasher cycle will energize motor 226. The fan or blower 229 will draw air through the blower housing and duct member inlet 182. The blower fan 229 will discharge the air upwardly through the duct portion of the blower housing and duct member 179. The discharged air flow will be split by the divider 196 and will pass upwardly on either side of the chamber portion of the vent stack. The air will be guided into the vent stack by the arcuate portions **204*b* and 204*c* of the blower housing and duct member top 204. From the vent stack, the air will be discharged through conduit 156 into the vat. This entrance of ambient air into the vat will cause the hot moisture laden air within the vat to exit through the door vents 8 and 9. At times when motor 226 is not energized and, due to heat within vat 2, the air therein is expanding, the embodiment of FIGS. 20 through 27 can serve as a vent, in addition to the door vents 8 and 9. In this instance, expanding air within the vat will enter the conduit 156 and pass upwardly through the vent stack 146 into the duct portion of the blower housing and duct member 179. Air within the blower housing and duct member will exit the assembly through the blower housing inlet 182**.

In this embodiment, as in the embodiment of FIGS. 2 through 19, the water inlet nozzle 140 and the vent stack 146 can be used alone, employing a smaller, modified tapping plate, such as tapping plate **111*a* of FIG. 28, being mounted to vat 13 in the same manner shown in FIG. 29, and functioning in the same manner described with respect to water inlet nozzle 16 and vent stack 34 of FIG. 29**.

Modifications may be made in the invention without departing from the spirit of it.

What is claimed is:

1. A water inlet, air vent, blower and blower housing combined assembly for use with a vat of an automatic dishwasher, said combined assembly comprising a water inlet nozzle, a vent stack, a blower housing, duct means, a motor and a fan, said water inlet nozzle having an inlet end and a discharge end, said vent stack comprising an open top chamber having front and rear sides, ends and a bottom, a lateral conduit extending from said front side adjacent said bottom, said conduit having a free end, means to mount said conduit free end in sealed relationship about an opening in said vat, said blower housing being located beneath said vent stack and having an inlet and an outlet, said duct means being located along side said vent stack, the lower end of said duct means being connected to one of said blower housing inlet and outlet, the upper end of said duct means being connected to and enclosing said open upper end of said vent stack, means to mount said motor in association with said blower housing, said fan being mounted in association with said blower housing and being operatively connected to said motor, and means to mount said water inlet nozzle above said vent stack with said discharge end thereof extending through said upper end of said duct means and downwardly into said vent stack chamber.

2. A water inlet, air vent, blower and blower housing combined assembly for use with a vat of an automatic dishwasher, said combined assembly comprising a water inlet nozzle, a vent stack, a blower housing, duct means, a motor and a fan, said water inlet nozzle having an inlet end and a discharge end, said vent stack comprising an open top chamber having front and rear sides, ends and a bottom, a lateral conduit extending from said front side adjacent said bottom, said conduit having a free end, means to mount said conduit free end in sealed relationship about an opening in said vat, said blower housing being located beneath said vent stack and having an inlet and an outlet, said duct means being located along side said vent stack, the lower end of said duct means being connected to one of said blower housing inlet and outlet, the upper end of said duct means being connected to and enclosing said open upper end of said vent stack, means to mount said motor in association with said blower housing, said fan being mounted in association with said blower housing and being operatively connected to said motor, and means to mount said water inlet nozzle above said vent stack with said discharge end thereof extending through an opening in said upper end of said duct means and downwardly into said vent stack chamber.

3. The assembly claimed in claim 2, wherein said duct means is connected to said blower housing inlet, said upper end of said duct means having at least one opening therein, whereby dry ambient air is mixed with air drawn from said vat through said vent stack conduit, said vent stack, and said duct means by said fan to decrease the moisture content per unit volume of the air exhausted by said fan through said blower housing outlet.

4. The assembly claimed in claim 3, wherein said water inlet nozzle comprises an elongated hollow body having an upper portion extending above said vent stack and a lower portion extending within said vent stack, said upper portion terminating in said inlet end, said lower portion terminating in said discharge end, said upper body portion having a longitudinal air gap opening formed therein and an elongated longitudinal baffle within said body whereby to prevent escape of water through said air gap opening.

5. The assembly claimed in claim 3, including a pair of planar baffles within said vent stack extending between said front and rear sides thereof and upwardly from said vent stack bottom toward said water inlet nozzle discharge end, said baffles being in parallel spaced relationship to either side of said water inlet nozzle discharge end, each of said baffles having a portion extending part way into said vent stack conduit.

6. The assembly claimed in claim 3, wherein said water inlet nozzle, said vent stack, said duct means and said blower housing are molded of plastic material.

7. The assembly claimed in claim 3, wherein said blower housing comprises a rear wall having an opening therein constituting said inlet and a spiral end wall defining said outlet, a blower plate removably affixed to said spiral end wall and constituting the front wall of said blower housing, a motor plate removably affixed to said blower plate, said motor being removably mounted to said motor plate, said motor having a shaft extending through perforations in said motor plate and said blower plate into said blower housing, said fan being affixed to said shaft, said duct means being removably affixed to said rear wall of said blower housing and said rear side of said vent stack.

8. The assembly claimed in claim 7, wherein said free end of said vent stack conduit is surrounded by a flange supporting a gasket, said flange having laterally extending ears with perforations adapted to receive screws extending through said vat into said ears, said blower plate having an upper portion with a perforation through which said fee end of said vent stack extends, said upper portion of said blower plate comprising a tapping plate for selected ones of said vent stack conduit flange ears.

9. The assembly claimed in claim 7, wherein said fan on said motor shaft comprises a squirrel cage fan.

10. The assembly claimed in claim 7, wherein said water inlet nozzle comprises an elongated hollow body having an upper portion extending above said vent stack and a lower portion extending within said vent stack, said upper portion terminating in said inlet end, said lower portion terminating in said discharge end, said upper body portion having a longitudinal air gap opening formed therein and an elongated longitudinal baffle within said body whereby to prevent escape of water through said air gap opening.

11. The assembly claimed in claim 10, including a pair of planar baffles within said vent stack extending between said front and rear sides thereof and upwardly from said vent stack bottom toward said water inlet nozzle discharge end, said baffles being in parallel spaced relationship to either side of said water inlet nozzle discharge end, each of said baffles having a portion extending part way into said vent stack conduit.

12. The assembly claimed in claim 11, wherein said free end of said vent stack conduit is surrounded by a flange supporting a gasket, said flange having laterally extending ears with perforations adapted to receive screws extending through said vat into said ears, said blower plate having an upper portion with a perforation through which said fee end of said vent stack extends, said upper portion of said blower plate comprising a tapping plate for selected ones of said vent stack conduit flange ears.

13. The assembly claimed in claim 12, wherein said fan on said motor shaft comprises a squirrel cage fan.

14. The assembly claimed in claim 2, wherein said duct means is connected to said blower housing outlet, whereby said fan, when actuated, introduces ambient air from said blower housing inlet into said vat via said duct means, said vent stack and said vent stack conduit.

15. The assembly claimed in claim 14, wherein said water inlet nozzle comprises an elongated hollow body having an upper portion extending above said vent stack and a lower portion extending within said vent stack, said upper portion terminating in said inlet end, said lower portion terminating in said discharge end, said upper body portion having a longitudinal air gap opening formed therein and an elongated longitudinal baffle within said body whereby to prevent escape of water through said air gap opening.

16. The assembly claimed in claim 14, including a pair of planar baffles within said vent stack extending between said front and rear sides thereof and upwardly from said vent stack bottom toward said water inlet nozzle discharge end, said baffles being in parallel spaced relationship to either side of said water inlet nozzle discharge end, each of said baffles having a portion extending part way into said vent stack conduit.

17. The assembly claimed in claim 14, wherein said water inlet nozzle, said vent stack, said duct means and said blower housing are molded of plastic material.

18. The assembly claimed in claim 14, wherein said blower housing and said duct means comprise a unitary, integral, one-piece part, the lower portion of which comprises said blower housing and the upper portion of which comprises said duct means, said lower blower housing portion and said upper duct means portion having a common rear wall, said lower blower housing portion having a perforation in said rear wall constituting said blower housing inlet, said lower blower housing portion being surrounded by a spiral end wall defining said blower housing outlet leading to said upper duct means portion, said upper duct means portion having end walls connecting said lower blower housing portion spiral end wall with said upper duct means end enclosing the upper end of said vent stack, said vent stack being removably received within said upper duct means portion, said vent stack front side comprising the front wall of said upper duct means portion, said vent stack end walls being spaced inwardly from said upper duct means portion end walls defining ducts to either side of said vent stack leading from said blower housing outlet to said upper duct means end and said upper end of said vent stack, a blower plate removably affixed to said spiral wall and constituting the front wall of said lower blower housing portion, a motor plate removably affixed to said blower plate, said motor being removably mounted to said motor plate, said motor having a shaft extending through perforations in said motor plate and said blower plate into said lower blower housing portion, said fan being affixed to said shaft.

19. The assembly claimed in claim 18, wherein said water inlet nozzle comprises an elongated hollow body having an upper portion extending above said vent stack and a lower portion extending within said vent stack, said upper portion terminating in said inlet end, said lower portion terminating in said discharge end, said upper body portion having a longitudinal air gap opening formed therein and an elongated longitudinal baffle within said body whereby to prevent escape of water through said air gap opening.

20. The assembly claimed in claim 19, including a pair of planar baffles within said vent stack extending between said front and rear sides thereof and upwardly from said vent stack bottom toward said water inlet nozzle discharge end, said baffles being in parallel spaced relationship to either side of said water inlet nozzle discharge end, each of said baffles having a portion extending part way into said vent stack conduit.

21. The assembly claimed in claim 20, wherein said free end of said vent stack conduit is surrounded by a flange supporting a gasket, said flange having laterally extending ears with perforations adapted to receive screws extending through said vat into said ears, said blower plate having an upper portion with a perforation through which said fee end of said vent stack extends, said upper portion of said blower plate comprising a tapping plate for selected ones of said vent stack conduit flange ears.

22. The assembly claimed in claim 21, wherein said fan on said motor shaft comprises a squirrel cage fan.

* * * * *